US005143219A

United States Patent [19]

Yates, Jr.

[11] Patent Number: 5,143,219

[45] Date of Patent: Sep. 1, 1992

[54] STACKABLE CONTAINER WITH PROTECTED LID SEAL

[76] Inventor: George Yates, Jr., 151 Cumberland Rd., Glendale, Calif. 91202

[21] Appl. No.: 681,783

[22] Filed: Apr. 8, 1991

[51] Int. Cl.[5] ..... B65D 41/16

[52] U.S. Cl. ..... 206/508; 220/306

[58] Field of Search ..... 206/508, 509; 220/306, 220/307; 150/55, 5

[56] References Cited

U.S. PATENT DOCUMENTS 3,516,571 6/1970 Roper et al. ..... 206/508
4,034,886 7/1977 Galer ..... 206/508
4,420,093 12/1983 Von Holdt ..... 206/508
4,512,493 4/1985 Von Holdt ..... 206/508
4,782,976 11/1988 Kenyon, 2nd ..... 206/508
4,928,839 5/1990 Kruelskie ..... 206/508

*Primary Examiner*—Joseph Man-Fu Moy
*Attorney, Agent, or Firm*—Walter A. Hackler

[57] ABSTRACT

A stackable container includes a continuous sidewall interconnecting a lip means and the bottom along with a lid for engaging the lip and for covering an open end of the stackable container. An elastic seal is provided between the lid and the lip when the lip is engaged by the lid and an interior shelf limits pressure applied to the plastic seal during stacking of the containers to prevent setting thereof.

15 Claims, 2 Drawing Sheets

FIG. 4.
(PRIOR ART)
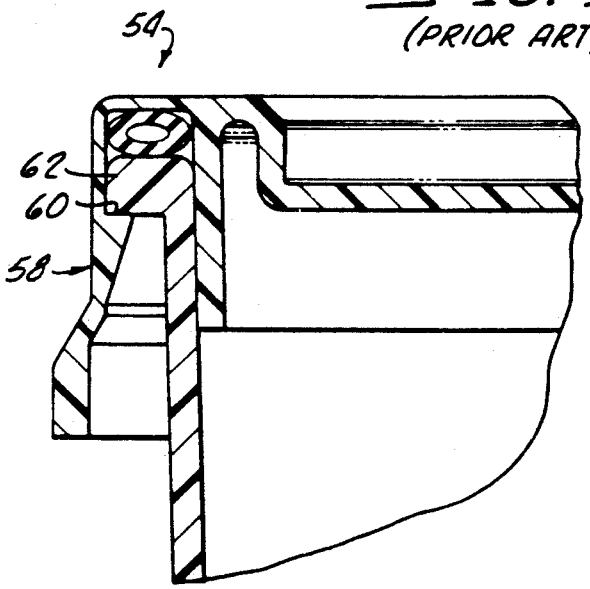
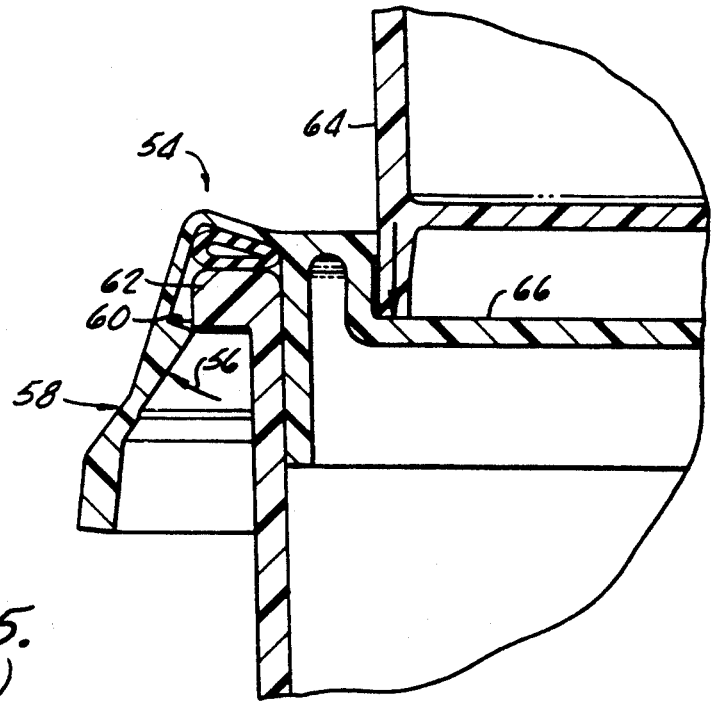
FIG. 5.
(PRIOR ART)

STACKABLE CONTAINER WITH PROTECTED LID SEAL

The present invention generally relates to plastic containers and more particularly is directed to large containers, or buckets, such as 5-gallon containers, capable of storage for long periods of time without degradation of the seal between the container lid and body. Particular importance of the present invention is the stackability of filled containers and resistance to degradation of the lid seal due to pressures developed between the lid and the container during prolonged storage.

Presently, containers molded from polyethylene or equal polymer thereof are utilized for the storage of a great number of liquids and chemicals which heretofore were stored in metal cans, or the like. Because of the corrosive resistance inherent in most plastic structures, the use of plastics in the molding of containers for the storage of liquids and chemicals have been on the increase.

Plastic container designs are developed to meet the structural requirements set by metal cans while at the same time maintaining lid seals which are secure under typical storage conditions. Standard storage procedures for containers includes the stacking of the containers on one another to increase the number count of containers per square foot of storage space available.

Unfortunately, heretofore designed plastic containers have not been satisfactory in providing durable seals during typical container storage.

Heretofore, lids for plastic containers were typically designed having an annular recess therein defined by parallel depending flexible flanges. Upon engagement with the lip of a container, an outside depending locking flange is used to lock the lid to lip and exert sealing pressure against the other depending sealing annular flange of the lid. While this provides an adequate seal, the design does not provide for a structurally sound lid capable of receiving pressures produced by up to 15 filled containers serially stacked thereon.

That is, with compressive forces, the lid tends to collapse and separate from the container lip. Even though a total collapse of the lid may not occur, the rupture of the seal between the lid and the container lip enables air to enter the containers which is generally undesirable.

Further, prolonged compressive forces during storage eventually distort the lid to the extent that the resiliency of the plastic from which it is formulated is insufficient to reestablish the seal. Consequently, subsequent tipping or rough handling of a container removed from a stack may result in leakage of the liquids from the container through the distorted seal between the lid and bucket lip.

In order to improve the stackability of such containers, radial ribs have been provided on an underside of the lid to support the sealing flange and interior portions of the lid. The support ribs provide increased lid strength; however, the seal between the container lip and sealing flange is weakened because of the non-uniform density of the sealing flange caused by abutting ribs. That is, because the sealing flange has abutting ribs, it is not uniformly resilient, and consequently a uniform seal between the sealing flange and container lip is not possible.

Another approach to increasing the stackability of a molded bucket is disclosed in Von Holdt U.S. Pat. No. 4,420,093. Specification of U.S. Pat. No. 4,420,093 teaches the use of an annular straight wall which is incorporated into a lid and positioned to engage an annular shelf in the wall of a mating bucket. In this manner, the force from the weight of stacked buckets is transmitted from the lid to the annular shelf. As a result of this, the bucket and lid are able to withstand greater loads and hence exhibit improved stacking strength.

Despite this improvement, compressive forces of long duration still cause distortion in the lid member and bucket lip member which provide sealing of the container. It can be appreciated that while a great portion of the force of stacked buckets on a lower bucket is directed to the sidewall of the lower bucket, the vector of such forces is not parallel to the sidewall of the container but, in fact, causes radial forces on the seal between the lid and bucket lip. Because the lids and buckets are generally made from a deformable plastic, long periods of compressive forces permanently set, or deform, the plastic to an extent preventing a "resilient" restoration of the seal between the lid and the bucket lip after the load is removed. Consequently, subsequent tipping or rough handling of the container may result in seepage of the liquids or chemicals contained therein through the distorted seal.

The present invention overcomes the deficiencies of the prior art and provides for a stackable container having a lid/container lip seal able to endure long periods of storage under compressive forces without losing the integrity of the seal.

SUMMARY OF THE INVENTION

A stackable container, in accordance with the present invention, generally includes lip means for defining an open end of the stackable container, a bottom and a continuous sidewall interconnecting the lip means and the bottom. Lid means are provided for engaging the lip means and for covering the stackable container open end and elastic means provide a seal between the lid means and the lip means when the means is engaged by the lip means. Importantly, means are provided for limiting compression of the elastic means when a load is applied to the lid means in a manner compressing the lid means against the lip means.

More specifically, the last mentioned means may provide for maintaining a constant compression seal between the lid means and the lip means with the elastic means therebetween, thus preventing deformation of the elastic means.

More particularly, the stackable container, in accordance with the present invention, may include means defining an interior shelf and the means for limiting pressure comprises ridge means attached to an underside of the lid means for engaging the interior shelf. Further, the ridge means may be sized to enable the ridge means to engage the interior shelf when the lid means engages the lip means and the elastic means is compressed to a preselected maximum limit. Alternatively, the ridge means may be sized to enable the ridge means to engage the interior shelf when the lid means engages the lip means and the elastic means is compressed to a preselected fixed limit. This latter embodiment enables a fixed deformation of the elastic means despite the compressive load caused by stacked containers, whereas the former embodiment provides for a maximum compressive load to be applied to the elastic means.

With specific reference to the elastic means, an O-ring may be used to provide the seal between the lid means and the lip means.

DESCRIPTION OF THE DRAWINGS

The advantages and features of the present invention will be better understood by the following description and drawings in which:

FIGS. 4 and 5 illustrate prior art containers and problems associated therewith.

DETAILED DESCRIPTION

Figure 1:
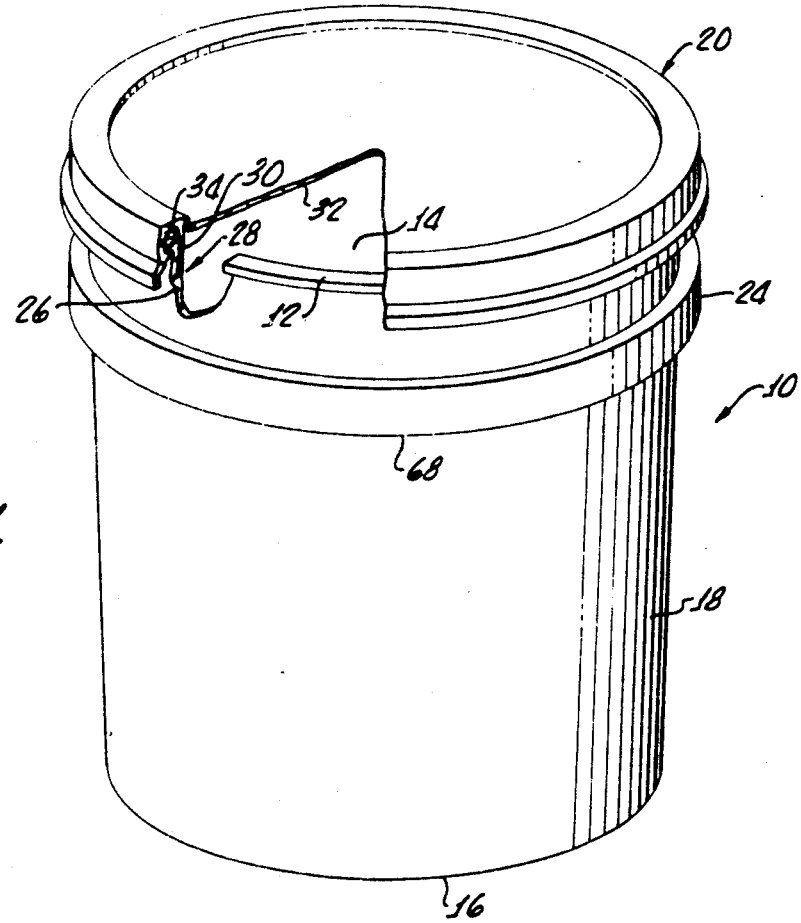
FIG. 1 is a perspective view of a stackable container in accordance with the present invention partially broken away to show a sealing arrangement between a lid and a container sidewall.

Turning now to FIG. 1, there is shown a stackable container 10, in accordance with the present invention, which generally includes a lip 12 which provides means for defining an open end 14 of the stackable container 10, a bottom 16 and a continuous sidewall 18 interconnecting the lip 12 and the bottom 16.

A lid 20 provides means for engaging the lip 12 and for covering the stackable container open end 14. The container 10 may be molded from any suitable synthetic resin material, such as polyethylene or a copolymer thereof.

The sidewall 18 may include a berm 24 molded thereinto to provide increased hoop strength of the sidewall and on an inside wall 26, a shelf 28 may be molded which, in cooperation with an inside depending member 30 molded to an underside 32 of the lid 20 provides means for limiting compression of an O-ring 34 when load is applied to the lid 20, a matter compressing the lid 20 against the lip 12.

The O-ring 34 provides elastic means for providing a seal between the lid 20 and the lip 12 when the lip 20 is engaged by the lid 12 any is formed from a material having long lasting resiliency, such as natural and/or synthetic elastomers having sufficient resiliency to seal, e.g., acrylic polymers and copolymers; ABS copolymers and other nitrile rubbers; hydrocarbon rubbers, e.g., sytrene-butadiene, ethylene-propylene terpolymers, polybutadiene and polyisoprene rubbers; etc., chlorine-containing rubbers, e.g., chloroprene copolymers such as Neoprene® rubbers available from du-Pont Co.; fluorinated elastomers; etc. such elastomers may be filled or compounded with pigments, fillers, antioxidants, etc., and other polymer additives known in the art.

Figure 2:
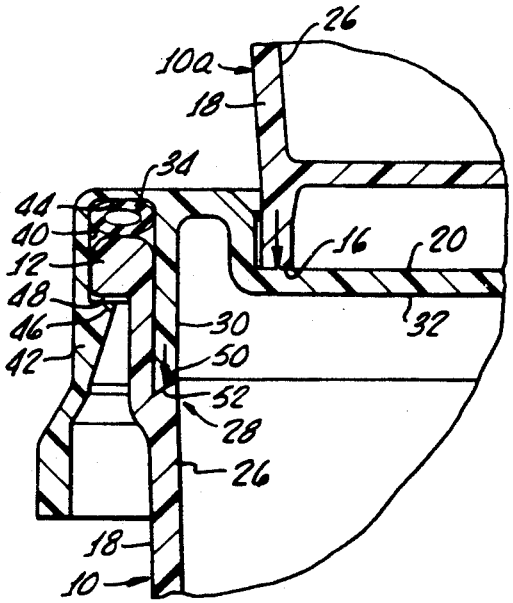
FIG. 2 is a cross-section view of portions of the lid and sidewall showing the sealing arrangement.

Turning now to FIG. 2, the lid 20 includes an annular channel 40, having an outside depending member 42, which provides means for locking the lid 20, in an engaged relationship with the lip 12 with the O-ring 34 compressed to a preselected limit between the lip 20 and a top underside surface 44 of the channel 40. A hook 46 molded into the outside depending member 42 is sized to engage an underside 48 of the lip 12. The compression of the O-ring 34, by the locking engagement of the hook 46 with the lip underside 48, provides a controlled pressure seal between the lid 20 and the lip 12. The compression of the O-ring 34 is limited when additional containers A are stacked upon the lid 20. As loading on the lid 20 compresses it against lip 12, the inside depending member 30 engages the shelf 26, thus transferring forces to the sidewall 18, effectively shunting such forces past the sealing O-ring 34. Since the compression of the O-ring 34, in a downward direction, is limited by the inside depending member 30, shelf 26 engagement, it remains resilient to any sidewall loading, unlike the prior art as hereinbefore discussed.

Importantly, the interior shelf 26 and said interior depending member 30 include mating surfaces 50, 52, respectively, disposed at an acute angle to the sidewall 18 which provide means for preventing radially outward movement of the outside depending member as occurs with prior art devices when one stackable container is stacked on the top of another stackable container. The mating surfaces 50, 52 essentially lock the interior depending member to the sidewall against transverse movement.

Such movement is illustrated in FIGS. 4 and 5, for prior art containers 54. The outward radial movement of a prior art outside depending member 58 is indicated by arrow 56. Such movement causes a prior art hook 60 to disengage from a prior art lip 62 when a second container 64 is stacked on the prior art lid 66. This movement is enabled by the yielding of the plastic material from which the containers 54, 64 are made.

It is readily apparent that the structure of the present invention overcomes this problem of prior art containers 54, 64.

Figure 3:
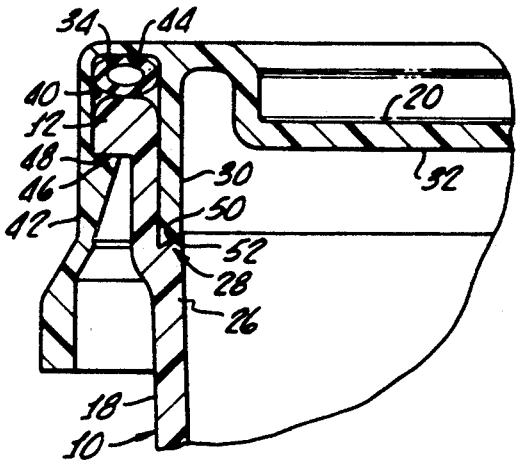
FIG. 3 is a cross-section view of an alternative embodiment of the present invention.

Alternatively, as shown in FIG. 3, the sizing of the outside depending member 42, hook 46, O-ring 34, shelf 26 and inside depending member 30, may be such that when the hook is in a latched position with the underside 48 of the lip 12, the inside depending member 30 is in the butting relationship with the shelf 26. This arrangement provides for a constant preselected compression on the O-ring 34 which is unaffected by the stacking of containers 10, 10*a* on one another in numbers up to 15 or 20. The latter embodiment, of course, requires more strict tolerances in the molded parts.

It should be apparent that the dimension of the outside depending member 42, hook 46, lip 12, O-ring 44, channel 40, inside depending member 30 and shelf 26, will vary depending upon the size of the container, wall thickness, intended weight capacity of the container, etc. Nonetheless, all of these parameters can be easily determined on a trial and error basis. As an example, however, it is expected to containers with from 0.090 to 0.100 inch wall thickness that the shelf 26, are offset, would have the dimensions of approximately one wall thickness, for 5-gallon containers.

As a result of the hereinabove described arrangements, the present invention exhibits improved stacking strength because of its ability to withstand greater loads on the lids 20.

It should be appreciated that the sidewall 18, may be tapered from the lip 12 to the bottom 16 in order to facilitate nesting of empty containers for shipment.

In this nested configuration, not shown, a bottom 68 of the beam of one container 10 rests on the lip 12 of a nested container.

Although there has been hereinabove described a specific arrangement of a stackable container, in accordance with the present invention, for the purpose of illustrating the manner in which the present invention may be used to advantage, it will be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A stackable container comprising:

lip means for defining an open end of the stackable container;

a bottom;

a continuous sidewall interconnecting said lip means and said bottom;

lid means for engaging said lip means and for covering the stackable container open end, said lid means comprising a depending member having an angled end surface;

elastic means for providing a seal between said lid means and said lip means when the lip means is engaged by the lid means;

means for limiting compression of the elastic means when load is applied to the lid means in a manner comprising the lid means against the lip means; and means for preventing radially outward movement of said continuous sidewall causing disengagement of the lid means from the lip means upon stacking of multiple stackable containers on one another with the bottom on one stackable container stacked on the top of another stackable container, said last recited means comprising a shelf molded into the sidewall and having a surface at an acute angle to the sidewall, said surface being configured, positioned and sized for mating with the lid angled end surface.

2. The stackable container according to claim 1 wherein said lid means includes means for locking the lid means in an engaged relationship with the lip means with the elastic means compressed to a preselected minimum limit.

3. The stackable container according to claim 2 wherein the continuous sidewall includes means defining an interior shelf and the means for limiting pressure comprises ridge means attached to an underside of said lid means for engaging said interior shelf.

4. The stackable container according to claim 3 wherein the ridge means is sized to enable the ridge means to engage the interior shelf when the lid means engages said lip means and the elastic means is compressed to a preselected maximum limit.

5. The stackable container according to claim 4 wherein the elastic means comprises an O-ring.

6. A stackable container comprising:

lip means for defining an open end of the stackable container;

a bottom;

a continuous sidewall interconnecting said lip means and said bottom;

lid means for engaging said lip means and for covering the stackable container open end, said lid means comprising a depending member having an angled end surface;

elastic means for providing a seal between said lid means and said lip means when the lip means is engaged by the lid means;

means for maintaining a constant compression seal between the lid means and the lip means with the elastic means therebetween; and means for preventing radially outward movement of said continuous sidewall, causing disengagement of the lid means from the lip means underside portion, upon stacking of multiple stackable containers on one another with the bottom on one stackable container stacked on the top of another stackable container, said last recited means comprising a shelf molded into the sidewall and having a surface at an acute angle to the sidewall, said surface being configured, positioned and sized for mating with the lid angled end surface.

7. The stackable container according to claim 6 wherein said lid means includes means for locking the lid means in an engaged relationship with the lip means with the elastic means compressed to a preselected fixed limit.

8. The stackable container according to claim 7 wherein the continuous sidewall includes means defining an interior shelf and the means for limiting pressure comprises a ridge means, attached to an underside of said lid means, for engaging said interior shelf.

9. The stackable container according to claim 8 wherein the ridge means is sized to enable the ridge means to engage the interior shelf when the lid means engages said lip means and the elastic means is compressed to the preselected fixed limit.

10. The stackable container according to claim 9 wherein the elastic means comprises an O-ring.

11. A stackable container comprising:

lip means for defining an open end of the stackable container;

a bottom;

a continuous sidewall interconnecting said lip means and said bottom;

lid means for engaging said lip means and for covering the stackable containers open end, said lid means comprising a depending member having an angled end surface;

elastic means for providing a seal between said lid means and said lip means when the lip means is engaged by the lid means;

means for preventing nonresilient deformation of the elastic means; and means for preventing radially outward movement of said continuous sidewall, causing disengagement of the lid means from the lip means, upon stacking of multiple stackable containers on one another with the bottom on one stackable container stacked on the top of another stackable container, said last recited means comprising a shelf molded into the sidewall and having a surface at an acute angle to the sidewall, said surface being configured, positioned and sized for mating with the lid angled end surface.

12. The stackable container according to claim 11 wherein said lid means includes means for locking the lid means in an engaged relationship with the lip means with the elastic means compressed.

13. The stackable container according to claim 12 wherein the continuous sidewall includes means defining an interior shelf and the means for limiting pressure comprises ridge means, attached to an underside of said lid means, for engaging said interior shelf.

14. The stackable container according to claim 13 wherein the ridge means is sized to enable the ridge means to engage the interior shelf when the lid means engages said lip means and the elastic means is compressed.

15. The stackable container according to claim 14 wherein the elastic means comprises an O-ring.

* * * * *